US006872089B1

(12) United States Patent
Chen

(10) Patent No.: US 6,872,089 B1
(45) Date of Patent: Mar. 29, 2005

(54) PUNCTURING TYPE CABLE COUPLING APPARATUS

(76) Inventor: Ching-Hsiung Chen, No. 77, Chuanfu Rd., Jente Hsiang, Tainan Hsien (TW)

( * ) Notice: Subject to any disclaimer, the term of this patent is extended or adjusted under 35 U.S.C. 154(b) by 0 days.

(21) Appl. No.: 10/700,111

(22) Filed: Nov. 3, 2003

(51) Int. Cl.[7] ..... H01R 4/24
(52) U.S. Cl. ..... 439/417; 439/622
(58) Field of Search ..... 439/395, 417, 439/651, 652, 622

(56) References Cited

U.S. PATENT DOCUMENTS 5,482,478 A * 1/1996 Liao ..... 439/622
6,120,315 A * 9/2000 Gaertner et al. ..... 439/395

FOREIGN PATENT DOCUMENTS

FR 2562337 * 10/1985 ..... H01R/13/52

* cited by examiner

*Primary Examiner*—Khiem Nguyen
(74) *Attorney, Agent, or Firm*—Dellett & Walters

(57) ABSTRACT

A puncturing type cable coupling apparatus that is implemented either as a plug or a receptacle is disclosed. The basic structure of the cable coupling apparatus includes a shell member and abase member, wherein the base member has a pair of terminal bridges containing claws, corresponding to a pair of backing blocks provided on the shell member, such that an inserted cable will be slightly bent and clamped down between the respective claws and the backing blocks when the base member and the shell member are fitted together. The driving force on the base member allows the claws to puncture the insulation jacket of the cable to force electrical contact with the copper wire inside. The main advantage is that the cable coupling apparatus can be attached on ends of a cable with no need of stripping the insulation jacket before the installation.

9 Claims, 11 Drawing Sheets

PUNCTURING TYPE CABLE COUPLING APPARATUS

BACKGROUND OF THE INVENTION

1. Field of the Invention

The present invention is related to a puncturing type cable coupling apparatus, and more particularly to a new connector design that can be installed on ends of an electric cable with no need of removing the outer jacket to expose the copper wire, and be able to function like a regular plug and receptacle.

2. Description of Related Art

Power connectors, used as an example, can be typically classified into two types by their external forms. The connector that has two or three prong-like conductive pins on the upper portion and a molded body on the lower portion is a male connector (called a plug hereinafter), and the connector formed by a molded body with two or three pin slots on the front panel is a female connector called a receptacle hereinafter), and these two types of connectors need to be mated together to provide a host machine with electrical current.

For the majority of electronic and electrical devices, they are provided with a power cable that has a pair of connectors on two ends, even though some of them may be mainly designed to use batteries. The plug attached on one end of the cable is used to connect to a power outlet and the receptacle on the other end is to be electrically connected to the host machine. Only when the plug is inserted into a power outlet, the host machine is able to draw in electrical current from the power source for the normal operation, regardless of the location of the host machine and the distance from a power source.

In general, a conventional plug is formed with a housing and a base. Inside the housing of the plug, there are usually two or more conductive pins mounted on the base and protruding outward, and each conductive pin is connected to a terminal that is fastened to a copper wire by a screw. A similar structure is also found in a conventional receptacle.

Since the conductive pins and the copper wires in the cable are simply joined by means of fastening screws, with no other auxiliary means of clamping down the cable, when someone tries to pull out a plug or receptacle by force after using the above plug or receptacle, the strong tension being exerted on ends of the cable may cause the copper wire to break off or become loosened from the terminal joint, resulting in an open circuit.

The conventional connector has gradually been replaced by a modified connector assembly that has strengthened the cable connection and the internal construction, which is composed of a shell member, a base member and two conductive plates. The two conductive plates are parallelly installed in the base member, using a clamping means on the inner surface of the conductive plate to clamp down the copper wires, and then the shell member is fitted over the base member to complete the installation of connector assembly on ends of the cable. This design can simplify the assembly procedure of the connector and the cable.

Though the connector assembly has strengthened the construction of conventional plug and simplified the installation, like other conventional connectors, it is still necessary to remove the insulation jacket of the cable to expose the copper wire before installing these connectors on ends of a cable, and the conventionally used clamping technique is also not reliable for ensuring a stable cable connection.

SUMMARY OF THE INVENTION

The main object of the present invention is to provide a puncturing type cable coupling apparatus that can be installed on ends of a cable with no need of removing the outer jacket of a cable, thus being able to promote easy installation and sturdy cable connection between the host machine and the power source.

To this end, the structure of the puncturing type cable coupling apparatus comprises two complementary members: a base member and a shell member, whereby the shell member receives the input cable, and then allows itself to be fitted over the base member on finishing the cable assembly.

The structures of the base member and the shell member are molded with insulation materials.

The base member is basically formed by a pair of conductive pins, a pair of terminal bridges, a holding bracket and a front panel.

The shell member is basically formed by a housing, a sunken portion, a pair of sliding guides, and a pair of backing blocks.

The puncturing type cable coupling apparatus is characterized in that the two terminal bridges of the base member are installed on the back side of the front panel, and are connected to the respective conductive pins.

The puncturing type cable coupling apparatus is also characterized in that the holding bracket of the base member is set up with two compartments inside the bracket walls, in which one terminal bridge is installed in each compartment.

The puncturing type cable coupling apparatus is also characterized in that the base member has a front panel with two pin slots on the surface for receiving another plug that can be inserted through the front panel to reach the terminal bridges in the compartment to make electrical connection with the conductive pins and the terminal bridges of the existing plug.

The puncturing type cable coupling apparatus is also characterized in that the cable coupling apparatus uses a pair of claws formed on the two terminal bridges of the base member to drive through the outer insulation jacket of a cable from the lateral sides, while a pair of backing blocks of the shell member provides the necessary countering force behind the inserted cable, such that the claws are able to force electrical contact with the inner copper wire by clamping down the cable between the claws and the backing blocks.

The puncturing type cable coupling apparatus is also characterized in that the shell member has a sunken portion formed toward the open end, which is used for receiving the conductive pins and the holding bracket to be inserted into the cavity created by the sunken portion.

The puncturing type cable coupling apparatus is also characterized in that the shell member has two wire slots on the bottom surface that allow a cable to pass through to the sunken portion.

The puncturing type cable coupling apparatus is also characterized in that the shell member has two backing blocks inside the sunken portion, extending in the transverse orientation, and the front end of the backing blocks stop in front of the wire slots, which are used to counter the driving force from the corresponding claws of the base member when the two complementary members are fitted together, such that the inserted cable can be properly positioned and secured by means of the claws and the backing blocks.

The puncturing type cable coupling apparatus is also characterized in that the base member has two open side pockets formed on two sides outside the bracket wall, wherein each side pocket holds a conductive pin and possibly another conductive pin from another plug that can be inserted through the pin slot.

The puncturing type cable coupling apparatus is also characterized in that there are two pin slots on the back wall of the shell member, wherein each pin slot is able to extend to the sunken portion, such that the conductive pins are able penetrate the shell member to the outside.

The puncturing type cable coupling apparatus is also characterized in that the base member contains a pair of fuse elements in the two compartments, wherein the two ends of each fuse element are respectively connected to a terminal bridge and a conductive pin.

The puncturing type cable coupling apparatus is also characterized in that the shell member has a pair of sliding guides formed on the upper side of the sunken portion extending in the transverse direction toward the open end, which is used to hold a slide cover with an open gap on the top surface.

The puncturing type cable coupling apparatus is also characterized in that the shell member has an opening on the top surface, corresponding to the position of the fuse elements installed in the base member when the two complementary members are fitted together, such that the slide cover can be opened or closed by moving the slide cover along the sliding guides in order to reach in and replace the fuse elements.

The puncturing type cable coupling apparatus is also characterized in that the base member has a pair of arresters provided along the bottom of the holding bracket wall of each side, such that each conductive pin can be secured in place by latching the anchoring means on the inner surface of the conductive pin to the bridge extension and resting in a pair of arresters at the bottom.

The puncturing type cable coupling apparatus is also characterized in that the shell member has a pair of notches on the rim of the shell member, whereas the base member has a pair of corresponding lugs provided on the rim of the front panel, one at the top and another at the bottom, such that the lugs and the notches can be interlocked against each other when the base member and the shell member are fitted together.

The terminal bridge of the cable coupling apparatus is also characterized in that the pair of claws in the base member are formed by U shaped metal plates for securing the cable and puncturing the outer jacket of the cable to make electrical contact with the copper wire thereunder, wherein the two claws are positioned side by side, each of which has a pair of pointed projections on the upper and lower part of the U shaped metal plate for clamping the inserted cable from the lateral sides.

The puncturing type cable coupling apparatus is also characterized in that the base member has kept the lower part of the holding bracket wall, toward the back end, open for the backing blocks of the shell member to pass through and enter the compartment of the base member when the two complementary members are fitted together.

The main advantage of the present invention over prior art is that the cable coupling apparatus can be easily installed on ends of a cable with no need of stripping the insulation jacket of the cable, whereby a cable can be inserted directly into the shell member and be secured between the claws of the base member and the backing blocks of the shell member when the shell member and the base member are fitted together. Because of the intrusive clamping on the cable, the risk of loosening or breaking can be considerably reduced, thus a sturdy cable connection can be assured.

Other objectives, advantages and novel features of the invention will become more apparent from the following detailed description when taken in conjunction with the accompanying drawings.

DETAILED DESCRIPTION OF THE PREFERRED EMBODIMENT

The present invention can be designed with two different versions to suit their respective functions either as a plug (male connector) or a receptacle (female connector), as the structure of these two versions is now explained through two preferred embodiments with reference to the accompanying diagrams.

Figure 1:
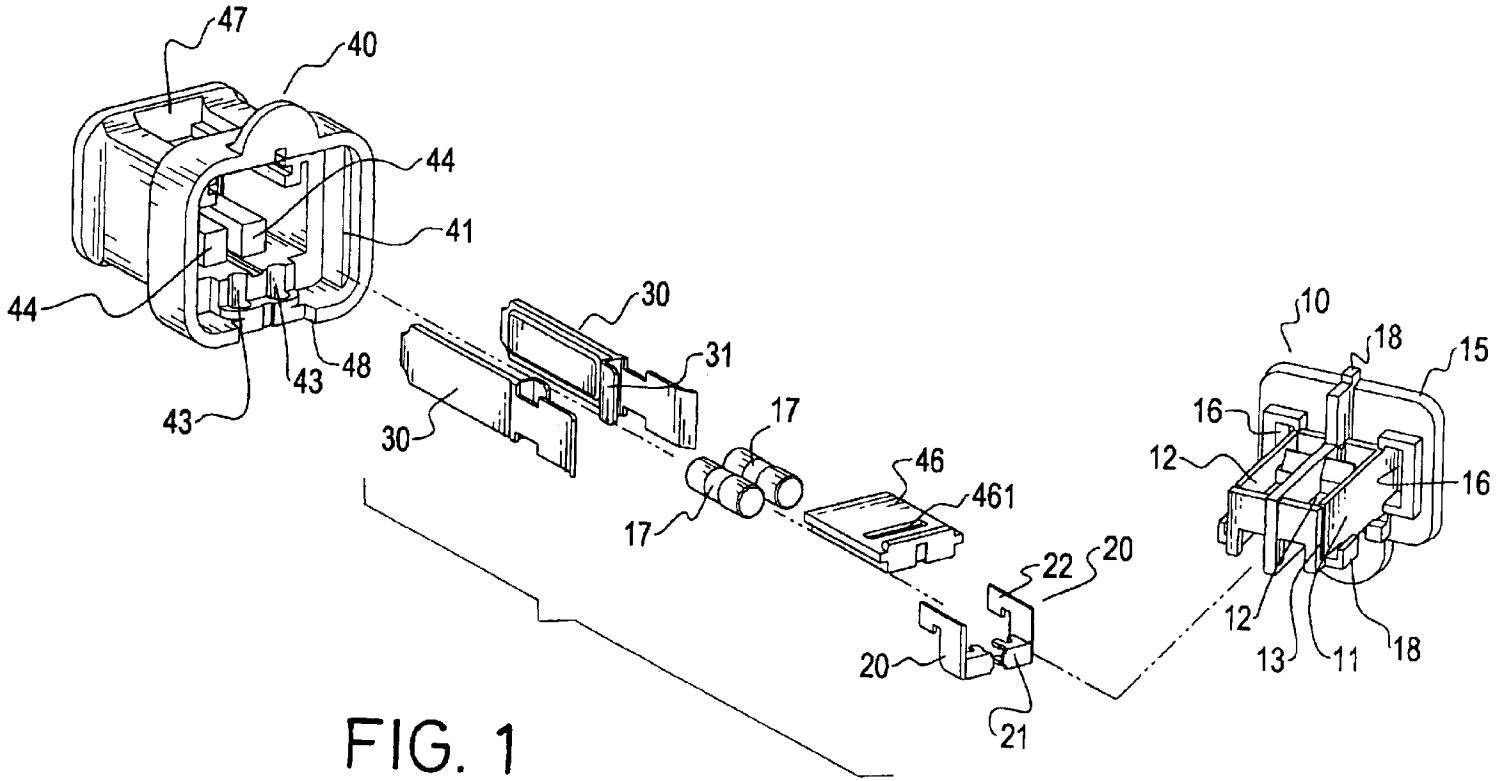
FIG. 1 is an exploded diagram of the first embodiment of the present invention.
Figure 2:
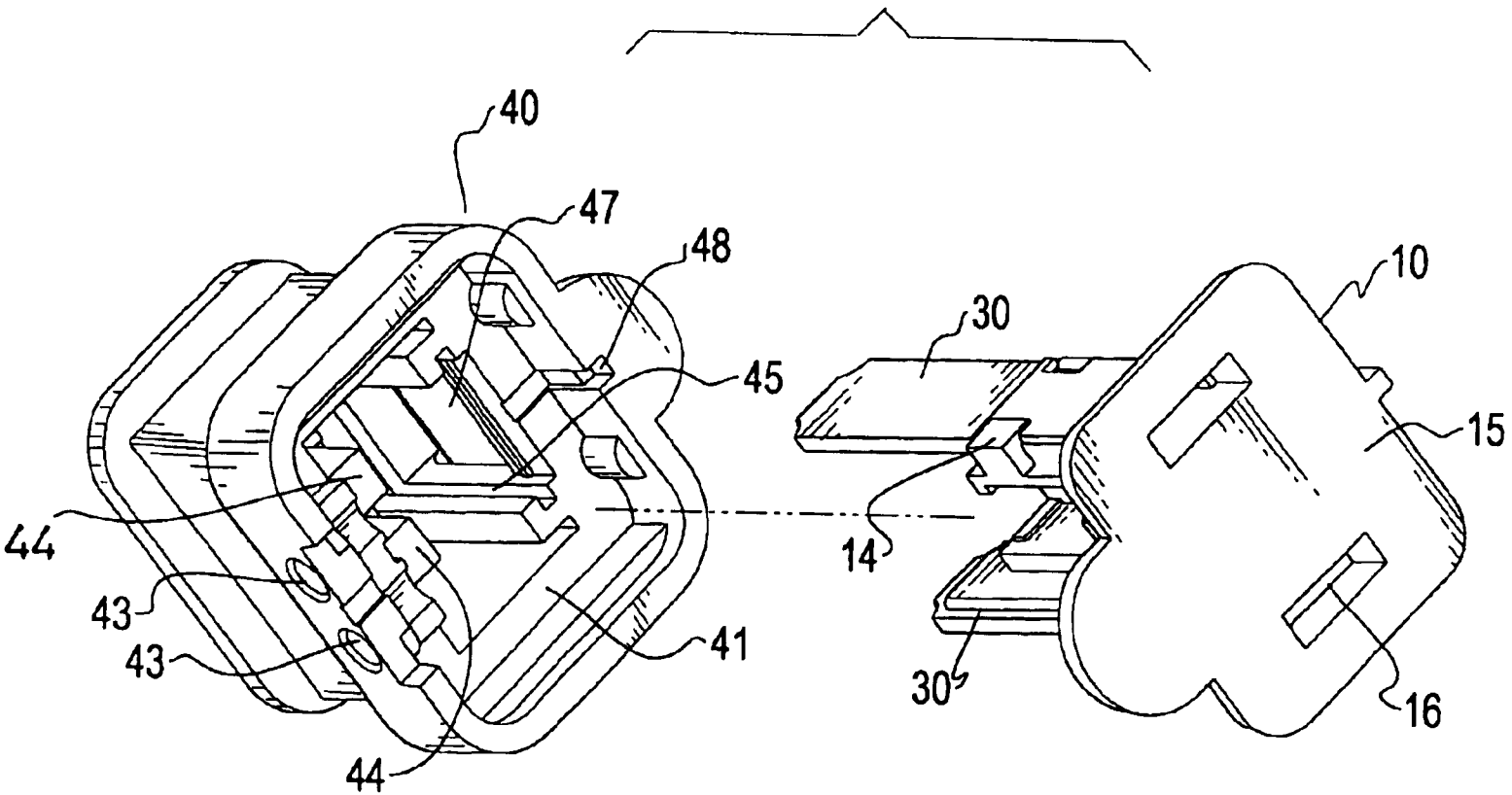
FIG. 2 is bottom perspective view of the puncturing type cable coupling apparatus before assembling with a cable.
Figure 3:
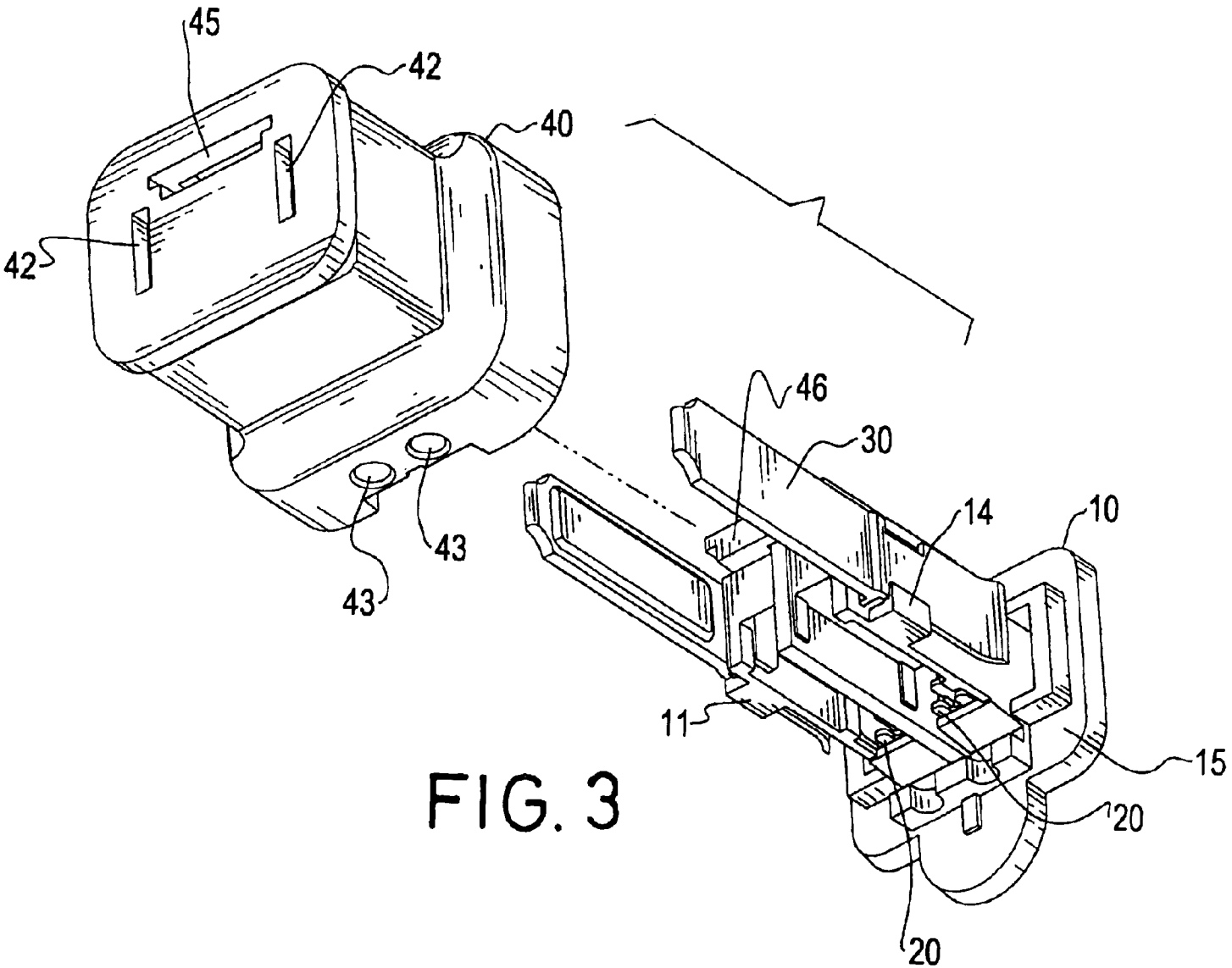
FIG. 3 is another bottom perspective view of the puncturing type cable coupling apparatus from another angle opposite to the position taken by FIG. 2.

In the first embodiment of the invention, as shown in FIGS. 1–3, the cable coupling apparatus, functioning as a plug, is formed by a base member (10), a pair of terminal bridges (20), a pair of conductive pins (30), and a shell member (40).

The base member (10) is molded with insulating material, wherein a holding bracket (11) is attached onto the back of a front panel (15), creating two compartments (12) within the inner space of the bracket walls (11), and having the top and bottom of the bracket (11) open to the outside, and two side pockets (13) are respectively formed on two sides outside the bracket wall (11), and two arresters (14) are provided at the bottom of the bracket wall (11).

The front panel (15) has a pair of pin slots (16) arranged in parallel that can extend downward to the respective compartment (12), which are used for receiving another plug that can be piggybacked onto the existing plug through the two pin slots (16).

The pair of terminal bridges (20), formed of copper, are installed in the compartment (12) of the base member (10), wherein each terminal bridge has a pair of claws (21) formed by a U shaped metal plate with pointed projections on the upper and lower side and disposed in the parallel orientation, which are used for puncturing the insulation jacket of the cable to make electrical contact with the copper wire and securing the cable; and a pair of extension hooks (22) erecting upright from the lateral side of the claws (21) to latch the conductive pins (30).

The pair of conductive pins (30) are formed by long and narrow metal strips that are installed on two sides of the holding bracket (11), within the space of the side pocket (13), secured by a pair of arresters (14) at the bottom, and latched onto the terminal bridges (20) by means of an anchoring means (31) formed on the inner surface of the conductive pin (30), such that the anchoring means (31) that is able to latch on the extension hook (22) of the terminal bridge (20).

The shell member (40), made from insulating material, has a sunken portion (41) extending towards the open end to correspond to the holding bracket (11) of the base member (10) when the two complementary members are fitted together, and also has a pair of pin slots (42) on the back end that is able to extend to the sunken portion (41) for receiving the conductive pins (30), and also has a pair of wire slots (43) at the bottom of the shell member (40) and near the open end of the sunken portion (41), which can also be extended upward to the sunken portion (41), and also has a pair of backing blocks (44) inside the sunken portion (41) extending in the transverse orientation and parallel to the conductive pins (30), and also has a pair of pin slot (42) on the back panel of the shell wall, wherein the front end of the backing blocks (44) can penetrate the holding bracket (11) through the lower part to reach the terminal bridges (20) in the compartments (12) of the base member (10).

The base member (10) is provided with a pair of fuse elements (17) in the two compartments (12), two ends of which are respectively connected to the extension hook (22) of the terminal bridge (20) and the anchoring means (31) of the conductive pin (30), which is able to break the circuit when the circuit is overloaded.

The shell member (40) is provided with a pair of sliding guides (45) on the upper part of the sunken portion (41) that extends in the transverse direction parallel to the backing blocks (44) for receiving a slide cover (46) with gap (461) on the top surface, and an opening (47) that can be extended downward to the sunken portion (41) if the slide cover (46) is open, wherein the front end of the slide cover (46) can be attached with a flange (462) to facilitate the opening and closing of the slide cover (46) for replacing the use elements (17).

The base member (10) is provided with a pair of lugs (18) on the rim of the front panel (15), one on top and another at the bottom, to correspond to the positions of the notches (48) on the rim of the shell member (40), such that the two lugs (18) and the two notches (48) can be interlocked against each other when the shell member (40) and the base (10) are fitted together.

Figure 4:
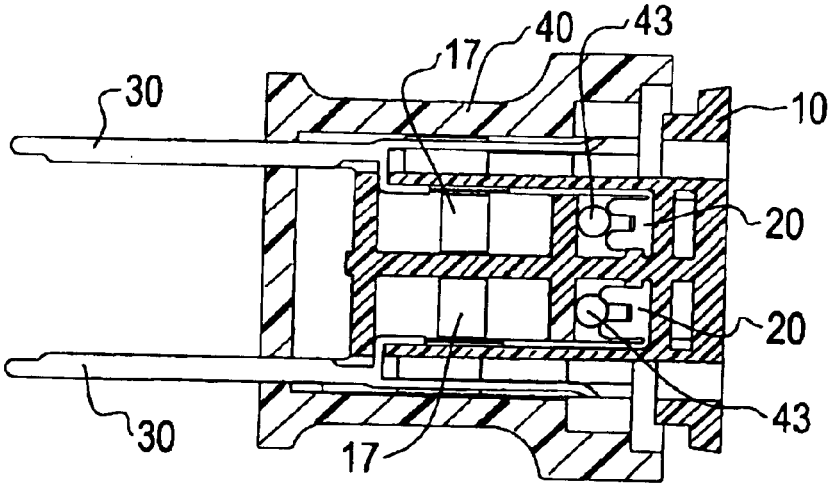
FIG. 4 is a cross-sectional diagram of the internal structure of the cable coupling apparatus before assembling with a cable.

According to the present invention, the plug version of the cable coupling apparatus can be pre-assembled with the conductive pins (30), the fuse elements (17) and the terminal bridges (20) installed on the base member (10) and then the base member (10) is inserted into the shell member (40) halfway as shown in FIG. 4. This pre-assembled plug can facilitate the final installation of the plug on the cable by a user not especially skilled in this field.

Figure 5:
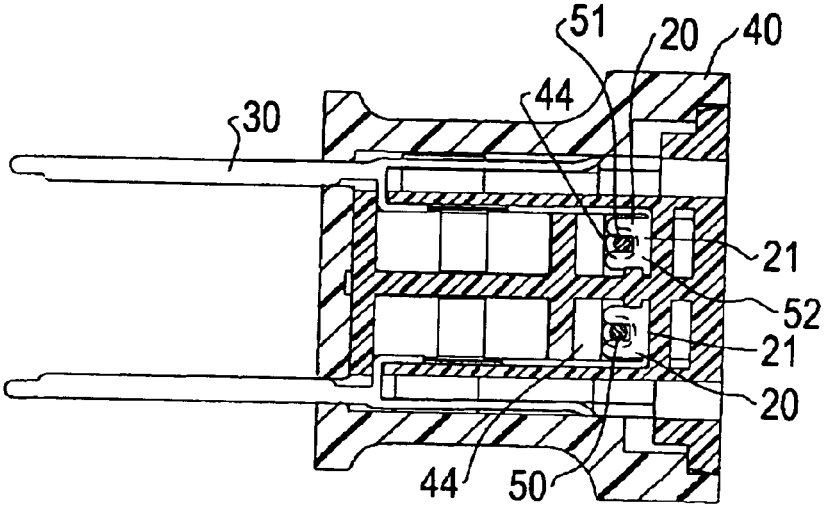
FIG. 5 is a cross-section view of the cable coupling apparatus fully assembled with the cable.

With reference to FIGS. 4 and 5, to assemble a plug onto a cable, users only have to put one end of the twin wire cable (50) into the pair of wire slots (43) at the bottom of the shell member (40) with no need of stripping the insulation jacket (51) of the cable (50) beforehand, and then push the front panel (15) of the base member (10) into the cavity area of the shell member (40) until the base member (10) is completely driven into the shell member (40). By doing so, the cable (50) will be slightly bent after passing through the internal structure of the shell member (40) and clamped between the claws (21) and the backing blocks (44) when the front panel (15) of the base member (10) is completely driven into the shell member (40).

Figure 6:
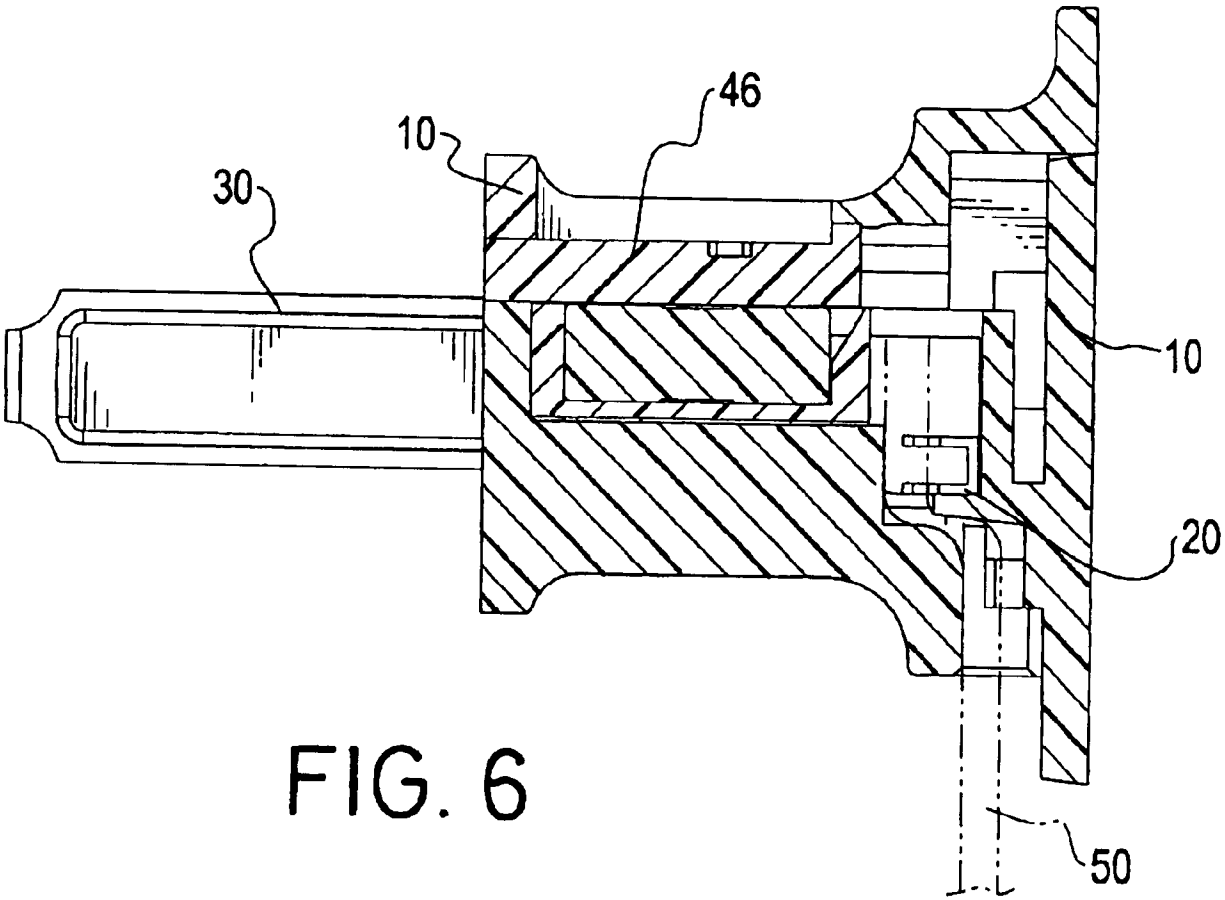
FIG. 6 is cross-section view of the cable coupling apparatus assembled with the cable.
Figure 7:
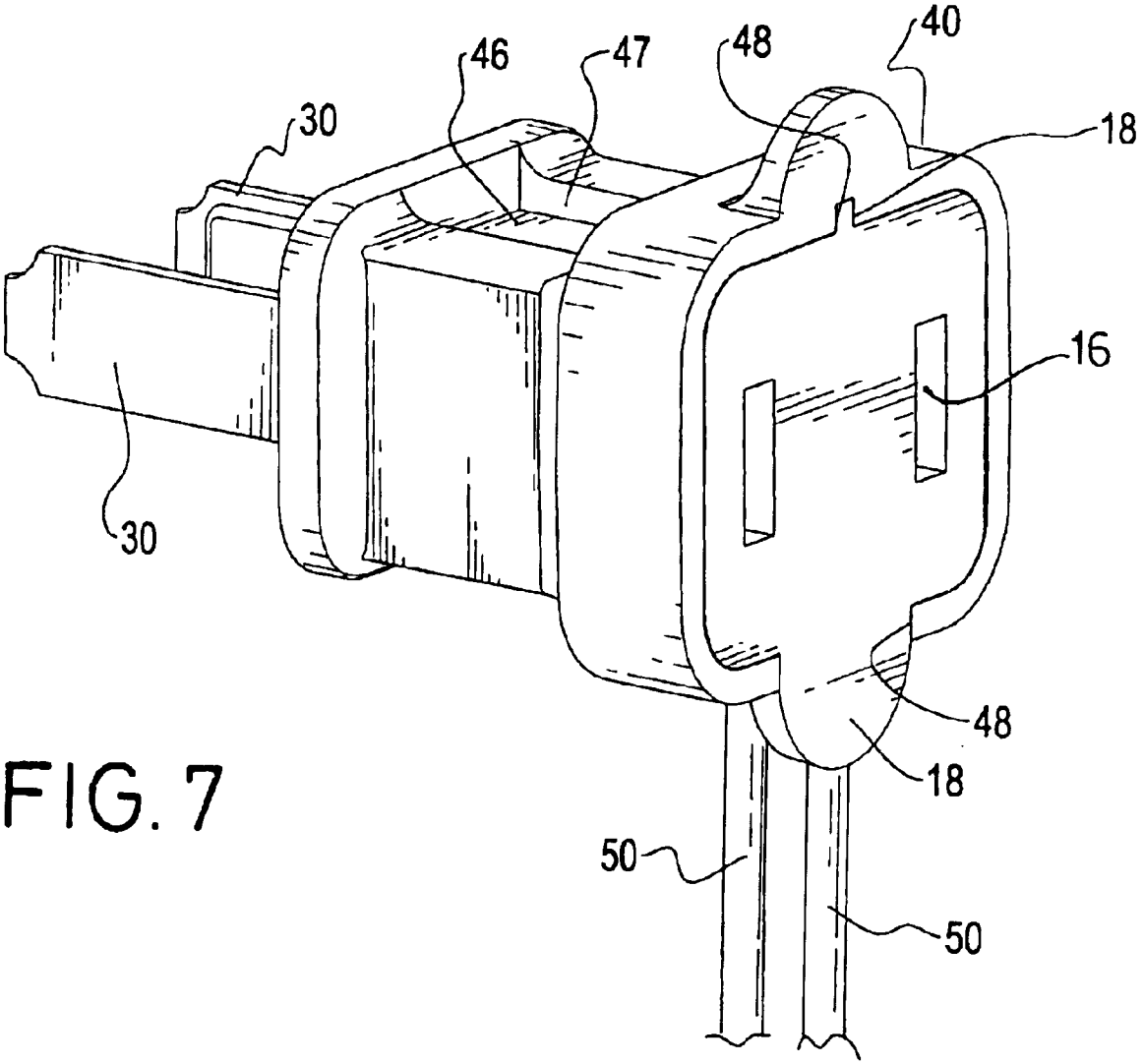
FIG. 7 is a perspective view of the cable coupling apparatus fully assembled with the cable.

Actually, when the two complementary members are fitted together, the pointed projections on the claws (21) of the terminal bridge (20) will be driven into the insulation jacket (51) of the cable (50) to force electrical contact with the copper wire (52) thereunder, and the cable (50) will be firmly secured between the claws (21) and the backing block (44) as shown in FIGS. 5, 6. A completely assembled plug with the cable (50) is shown in FIG. 7. The plug having two conductive pins (30) is used to connect to a power outlet, while the receptacle having two pin slots is connected to a host machine, such that the host machine is able to draw in electrical current from the power source for the normal operation. Also, the pin slot (16) on the front panel (15) of the base member (10) permits a second plug to be piggy-backed onto the existing plug to allow two machines to share the same power source.

When replacing the fuse elements in the plug, a regular screwdriver or equivalent tool may be used to reach in through the opening (47) of the shell member (40), which then moves the slide cover (46) toward the back end of the plug to expose the fuse elements (17) thereunder.

Figure 9:
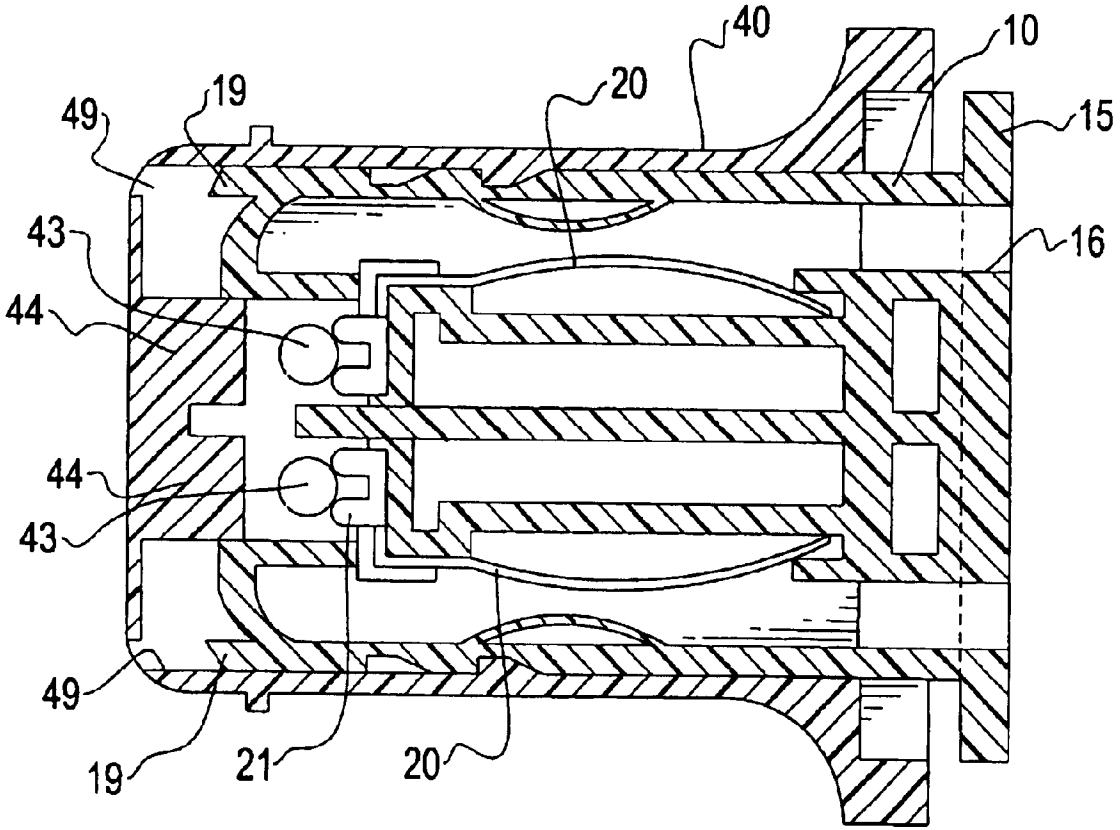
FIG. 9 is a top plan view of the internal structure of the cable coupling apparatus shown in FIG. 8 before assembly with the cable.
Figure 10:
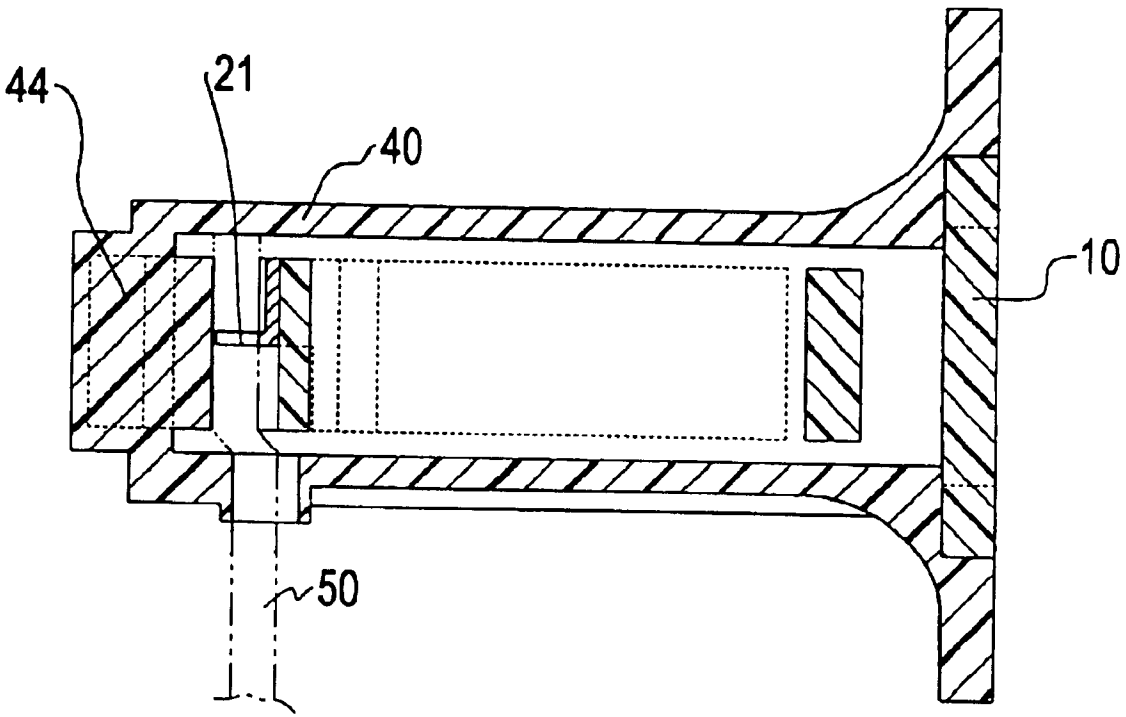
FIG. 10 is a side plan view of the structure of the cable coupling apparatus shown in FIG. 8.

According to the present invention, another embodiment of the cable coupling apparatus, as shown in FIGS. 9 and 10, comprises a base member (10), a pair of terminal bridges (20) and a shell member (40).

Figure 8:
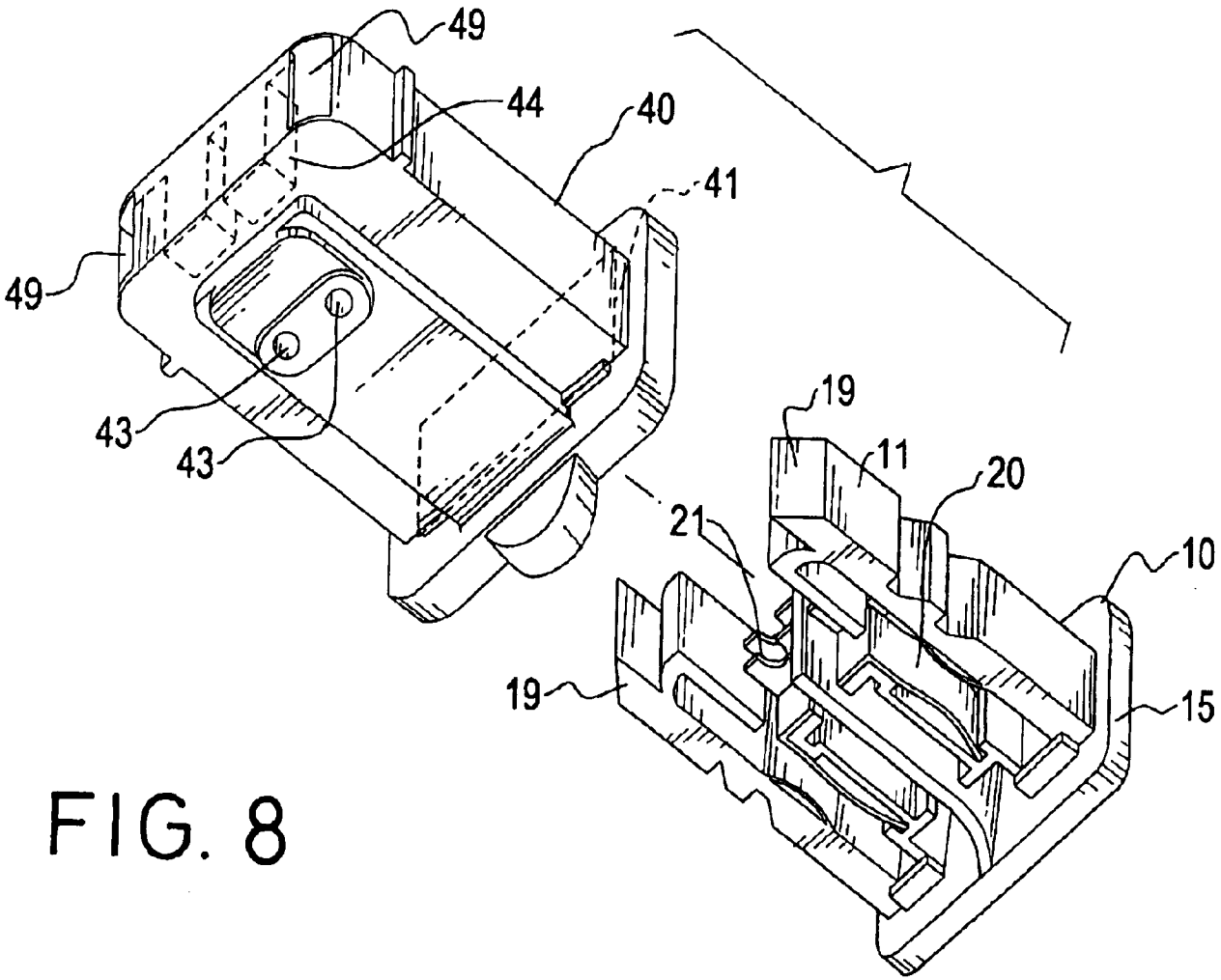
FIG. 8 is an exploded perspective view of the second embodiment of the present invention.

The base member (10), as shown in FIGS. 8 and 9, has a holding bracket (11) attached to the back end of a face panel (15), creating two compartments (12) within the inner space of the holding bracket wall (11), where the top and bottom of the holding bracket (11) are open to the outside. The front panel (15) has two parallel pin slots (16) that can be extended to the compartment (12) for receiving a mating plug.

Each terminal bridge (20) installed on the base member (10) has a claw (21) and an extension hook (22), wherein the claw (21) is formed by a U shaped metal plate with parallelly arranged pointed projections on the upper and lower part for puncturing the cable (50); and the extension hook (22) erected from the lateral side of the claw (21) is to latch the conductive pins (30).

The shell member (40) has a sunken portion (41) toward the open end, wherein the back end of the shell member (40) is sealed leaving a pair of pin slots (42) on the back panel; and a pair of wire slots (43) on the bottom wall that can be extended to the sunken portion (41) for receiving the cable (50). The shell member (40) also has a pair of backing blocks (44) in the sunken portion (41), in parallel arrangement and extending in the transverse direction, wherein the front end of the two backing blocks (44) stops in front of the two wire slots (43), wherein the backing blocks (44) can penetrate the holding bracket (11) of the base member (10) into the two compartments (12) when the shell member and the base member are fitted together.

In the second embodiment of the invention, the base member (10) has a pair of locating pins (19) on two sides of the holding bracket (11) that correspond to the through holes (49) on the back end of the shell member (40) that extend to the sunken portion (41).

The receptacle version of the cable coupling apparatus in accordance with the present invention can also be pre-assembled, as shown in FIG. 9, with the two terminal bridges (20) installed on the base member (10), and then the partially assembled base member (10) is inserted into the shell member (40) half way. This pre-assembled receptacle can facilitate the final installation on the cable by a user not especially skilled in this field.

To assemble the receptacle onto a cable, users only have to put one end of the twin wire cable (50) into the pair of wire slots (43) at the bottom of the shell member (40) with no need of stripping the insulation jacket (51) of the cable (50) beforehand, and then push the front panel (15) of the base member (10) into the cavity area of the shell member (40) until the base member (10) is completely driven into the shell member (40).

Figure 11:
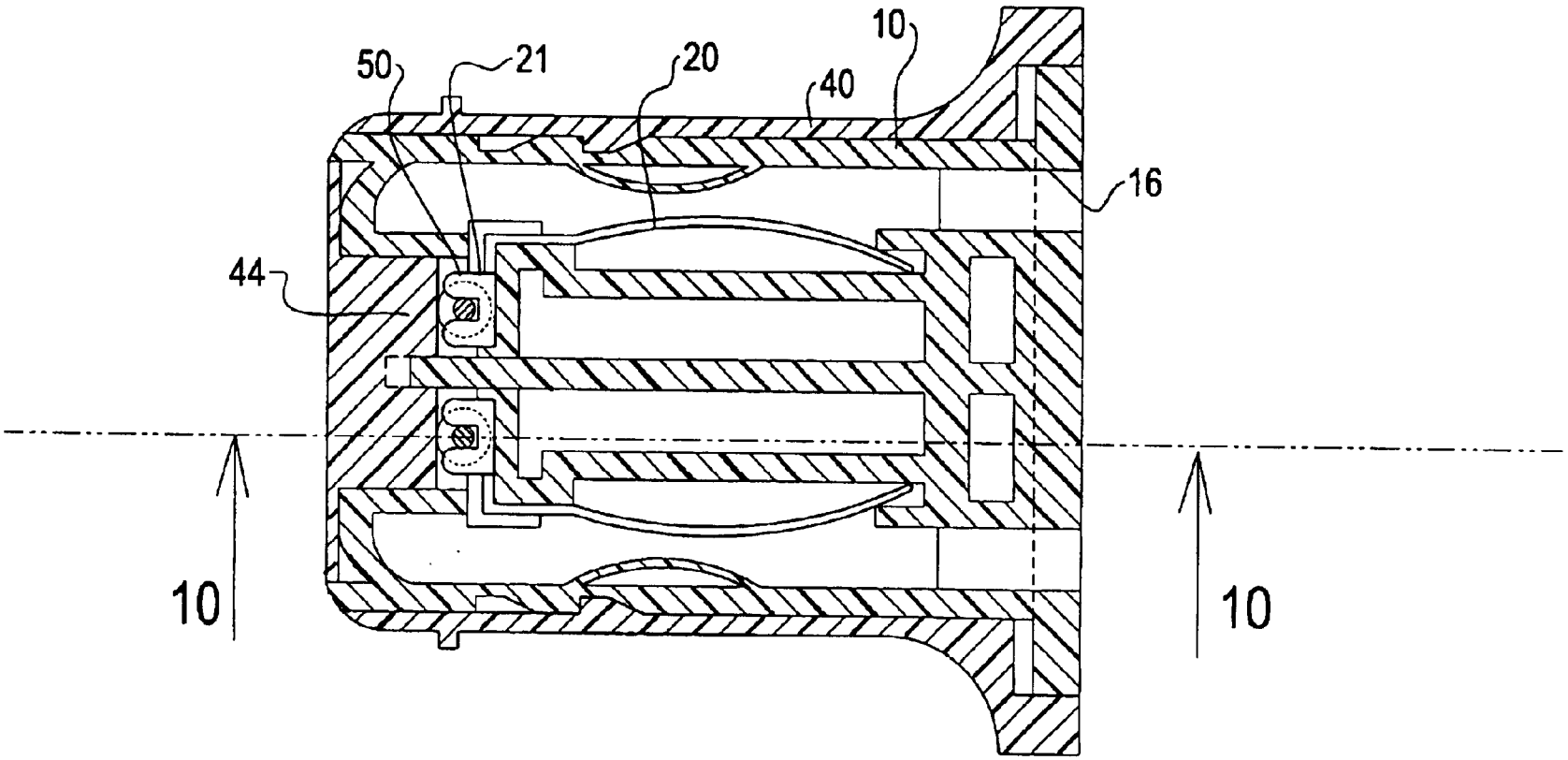
FIG. 11 is a top plan view of the cable coupling apparatus shown in FIG. 8 assembled with a cable.
Figure 12:
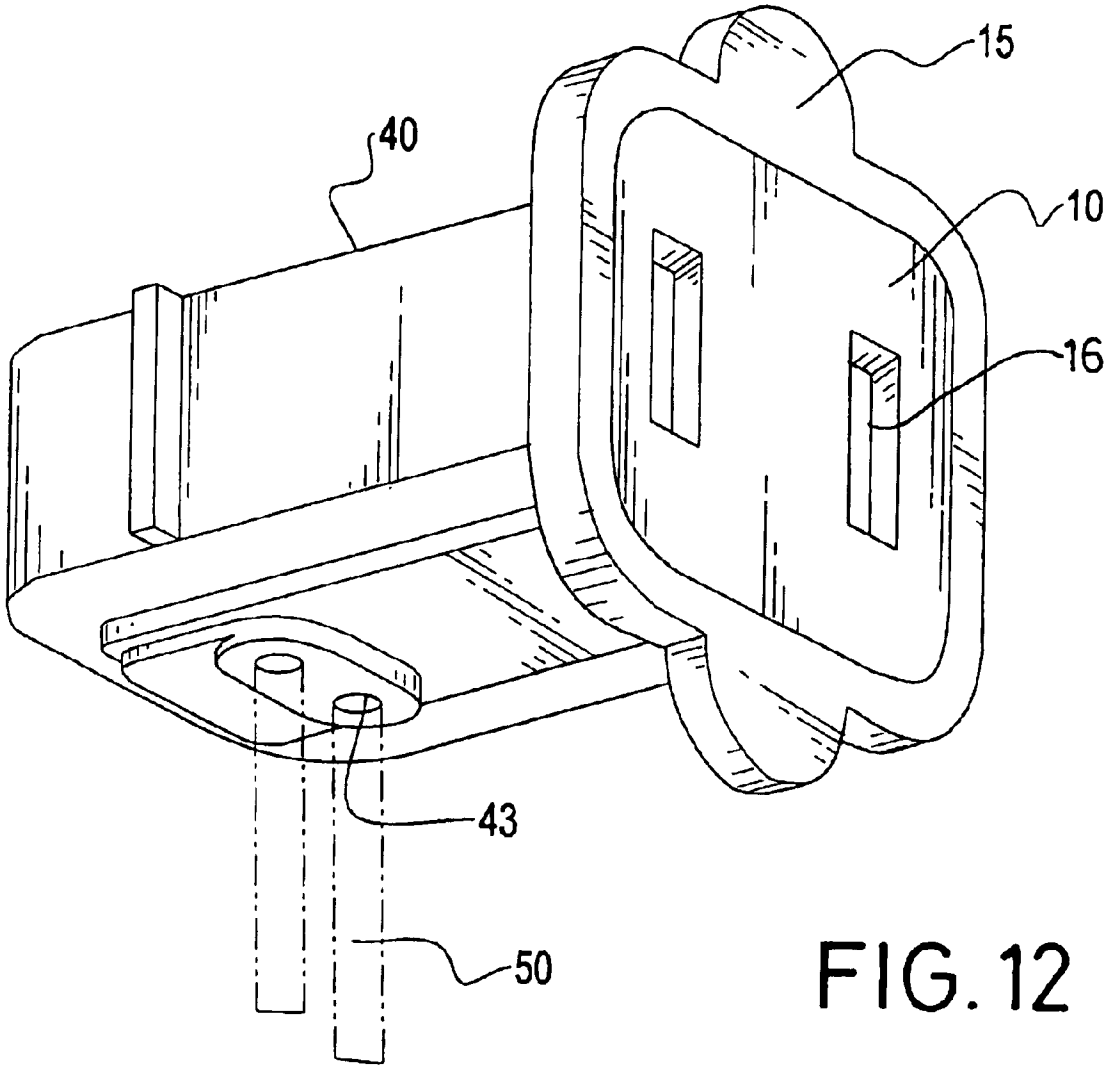
FIG. 12 a perspective view of the second embodiment of the invention assembled with a cable.

The assembling procedure of the receptacle is similar to that for the plug version. By doing so, the pointed projections of the claw (21) on the terminal bridge (20) will be driven into the insulation jacket (51) of the cable (50) to force electrical contact with the copper wire (52) underneath, and the cable (50) will be secured between the claws (21) and the backing blocks (44) as shown in FIGS. 10 and 11. The fully assembled receptacle is shown in FIG. 12, where the pin slot (16) on the front panel (15) receives the conductive pins (30) of the plug to be mated with the terminal bridge (20) to allow electricity conduction through the cable connection.

From the foregoing, the main advantage of the puncturing type cable coupling apparatus over prior art is that the cable coupling apparatus can be installed on ends of a cable with no need of stripping the insulation jacket of the cable beforehand. This design is equally applicable to the plug version and the receptacle version to suit different installation requirements, thus providing power users with an easy way to assemble the plug and or receptacle on a power cable, while a sturdy cable connection is assured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A puncturing type cable coupling apparatus for connection with a cable comprising a base member and a shell member, wherein the base member has a front panel located on a front end of the base member; two terminal bridges positioned to join with the cable, where each terminal bridge is formed by a claw and an extension hook; and a holding bracket installed on a back side of the front panel and having two compartments within boundaries of the bracket walls; wherein the two terminal bridges are respectively received in the two compartments, and the front panel has two pin slots extending to the compartments; and the shell member has a sunken portion in which two parallel backing blocks are formed, and two wire slots formed on the bottom surface of the shell member extended to the sunken portion for receiving the cable; wherein each backing block is inserted through a lower part of the holding bracket of the base, member into the compartment when the shell member and the base member are fitted together.

2. The puncturing type cable coupling apparatus as claimed in claim 1, wherein the base member has two open side pockets respectively defined in two sides of the holding bracket; two conductive pins latched onto the terminal bridge through an anchoring means in the middle section of each conductive pin; and two pin slots defined in a back end of the shell member for receiving the two conductive pins to be inserted through the sunken portion to an exterior of the cable coupling apparatus.

3. The puncturing type cable coupling apparatus as claimed in claim 2, wherein the base member has two fuse elements respectively placed in the two compartments, wherein the two ends of each fuse element are respectively connected to the terminal bridge and the conductive pin.

4. The puncturing type cable coupling apparatus as claimed in claim 2, wherein the shell member has a pair of sliding guides on an upper part of the sunken portion, extending in the transverse direction and parallel to the backing blocks, for receiving a slide cover to be installed between the two sliding guides, and an opening defined in the top surface extended to the sunken portion.

5. The puncturing type cable coupling apparatus as claimed in claim 2, the base member has two arresters at a bottom of the holding bracket and respectively on two sides of the holding bracket, whereby the two conductive pins are secured.

6. The puncturing type cable coupling apparatus as claimed in claim 1, the base member has two notches defined in a rim of the front panel, one of the notches defined at a top of the front panel and the other notch defined at a bottom of the front panel and corresponding to locations of the two lugs on the shell member, whereby the notches and the lugs are interlocked against each other when the base member and the shell member are fitted together.

7. The puncturing type cable coupling apparatus as claimed in claim 1, wherein each claw on the terminal bridge is formed by a U shaped metal plate.

8. The puncturing type cable coupling apparatus as claimed in claim 1, wherein each claw on the terminal bridge is formed by two U shaped metal plates, which are arranged one over the other in parallel and both U shaped metal plates are joined on their back side.

9. The puncturing type cable coupling apparatus as claimed in claim 1, wherein a back end of the lower part of the holding bracket has two open areas allowing the two backing blocks of the shell member to pass through the open areas to enter the respective compartment when the two members are fitted together.

* * * * *